US007932450B2

(12) United States Patent
Chen

(10) Patent No.: US 7,932,450 B2
(45) Date of Patent: Apr. 26, 2011

(54) CAPOS

(76) Inventor: Chang-Hsien Chen, Taichung County (TW)

( * ) Notice: Subject to any disclaimer, the term of this patent is extended or adjusted under 35 U.S.C. 154(b) by 0 days.

(21) Appl. No.: 12/539,626

(22) Filed: Aug. 12, 2009

(65) Prior Publication Data

US 2011/0036229 A1 Feb. 17, 2011

(51) Int. Cl.
*G10D 3/00* (2006.01)

(52) U.S. Cl. ..... 84/318

(58) Field of Classification Search ..... 84/318
See application file for complete search history.

(56) References Cited

U.S. PATENT DOCUMENTS 3,933,073 A * 1/1976 Hutchins ..... 84/318
4,143,576 A * 3/1979 Nichols et al. ..... 84/318
4,149,443 A * 4/1979 Bringe ..... 84/318
4,324,165 A * 4/1982 Wilkerson ..... 84/318
5,117,723 A * 6/1992 Veenschoten ..... 84/318
6,459,025 B1 * 10/2002 D'Addario ..... 84/318
6,635,813 B2 * 10/2003 Campling ..... 84/318
2004/0261600 A1 * 12/2004 Silva ..... 84/318
2010/0224049 A1 * 9/2010 Tran ..... 84/318

* cited by examiner

*Primary Examiner* — Elvin G Enad
*Assistant Examiner* — Robert W Horn
(74) *Attorney, Agent, or Firm* — Muncy, Geissler, Olds & Lowe, PLLC

(57) ABSTRACT

A capo has a string press element with an arm and a lever clamp that are coupled to form a clamping opening. The lever clamp has an adjustment end to adjust the size of the clamping opening. A trigger is provided to implement clamping operation. The clamping opening can clamp frets of a guitar. The capo can be quickly and easily deployed by a user single-handed through the trigger during playing the guitar. The capo is formed in a simple and neat profile, and provides a desirable match with performers or female performers to enhance appeal.

9 Claims, 7 Drawing Sheets

CAPOS

FIELD OF THE INVENTION

The present invention relates to a capo for guitars and particularly to a capo that has a snap trigger and adjustable clamp opening to facilitate tune setting.

BACKGROUND OF THE INVENTION

Capo is mounted onto frets of a guitar to adjust high and low pitches. Refer to FIGS. 1 and 2 for two types of conventional capos. In FIG. 1, a string press bar 1*a* has an extension arm 2*a* connecting to a positioning clamp 3 through a spring 5. When a handgrip 4 receives a force, the spring 5 can be moved. When in use, a performer needs a greater force to clip the fret, thus is difficult to move to the desired fret or remove therefrom, especially to female users.

FIG. 2 illustrates another type of capo designed to overcome the drawback of the aforesaid capo. It has an adjustment screw 6 running through a holding plank 7 and connecting to a positioning clamp 8 to incorporate with a string press bar 1*b* equipped with an extension arm 2*b* to provide desired function. It provides an improvement by turning the screw. However, screw turning involves tedious movement and impairs performance. A capo mentioned above is needed to be set on a desired fret to adjust the high or low pitch.

All these show that the conventional techniques still leave a lot of room for improvement. How to make tuning of guitars faster and easier is an issue still pending to be resolved.

SUMMARY OF THE INVENTION

Therefore, the primary object of the present invention is to provide a capo that can be quickly and easily moved and clamped on the frets of a guitar.

To achieve the foregoing object, the capo according to the invention includes a string press element, a trigger and a lever clamp. The string press element has two ends, one is a string press end and the other end extended upwards to form an arm with an action end. The arm has a trigger slot at one side remote from the string press end with two side walls formed thereon. The action end has a first axle hole formed on the two side walls.

The trigger is held in the trigger slot, and has a second axle hole pivotally coupled in the trigger slot. The trigger is an elongate plank with an upper end and a lower end. The upper end is a sliding end. The lower end is an operating end. The lever clamp has a clamping end at one end and an adjustment end at another end. The adjustment end is located above the sliding end of the trigger and has a screw hole run through by an adjustment screw. Below the lever clamp has a first trenched axle. The first trenched axle and an elastic element are hinged on the first axle hole. The clamping end and the string press end form a clamping opening.

The capo thus formed provides many benefits, notably:

1. The first axle hole, sliding end and second axle hole form triangular fulcrums. Incorporating with the lever clamp and a roller, the trigger, lever clamp and the string press element form the clamping opening. Such a design provides labor-saving and easier clamping adjustment regardless different sizes and heights of guitar frets. Through the trigger, performers can easily and quickly move the clipping location on the strings. It helps the performers to get a smoother performance.

2. Aside from providing improved practicality, the invention also offers more aesthetic appeal. First, the trigger slot is provided to hold the trigger; second, the first trenched axle allows the lever clamp to be hinged on the first axle hole. Hence the whole profile is neat, elegant and simpler. It is more helpful and appealing to performers.

The foregoing, as well as additional objects, features and advantages of the invention will be more readily apparent from the following detailed description, which proceeds with reference to the accompanying embodiments and drawings. The embodiments serve merely for illustrative purpose and are not the limitation of the invention.

DETAILED DESCRIPTION OF THE PREFERRED EMBODIMENTS

Figure 1:
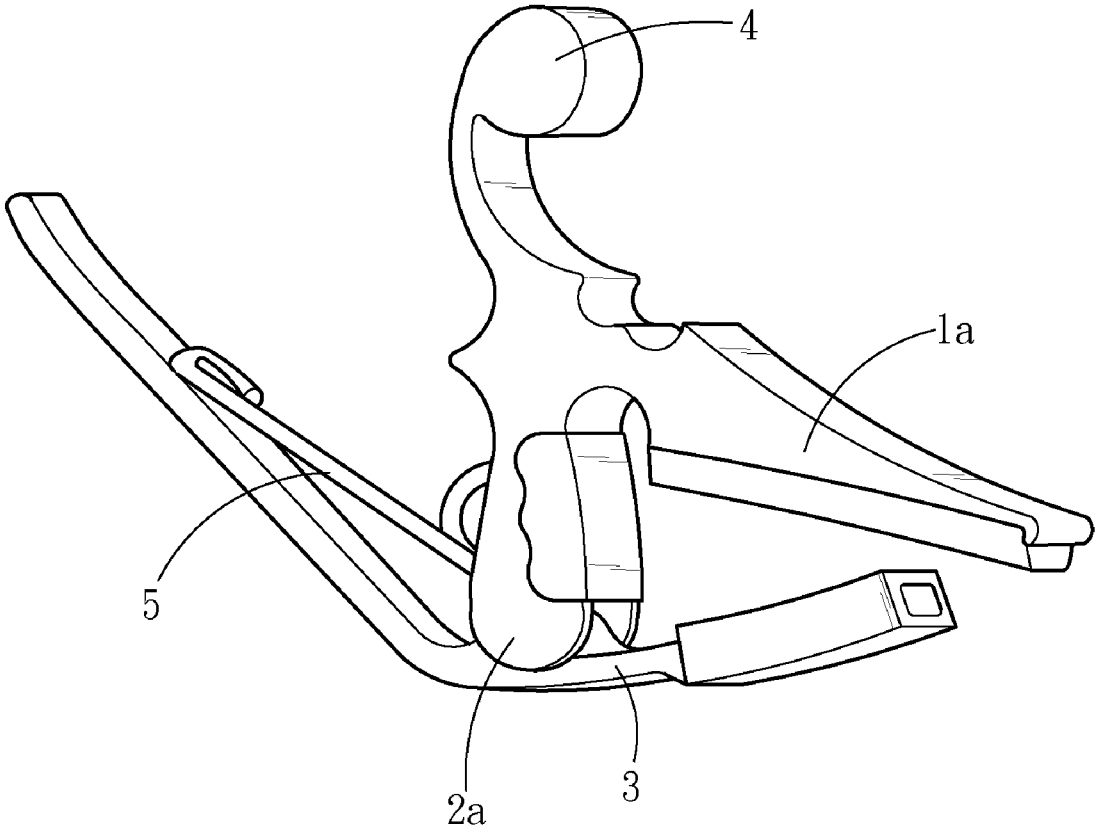
Fig. 1 PRIOR ART
FIG. 1 is a schematic view of a first conventional capo.
Figure 2:
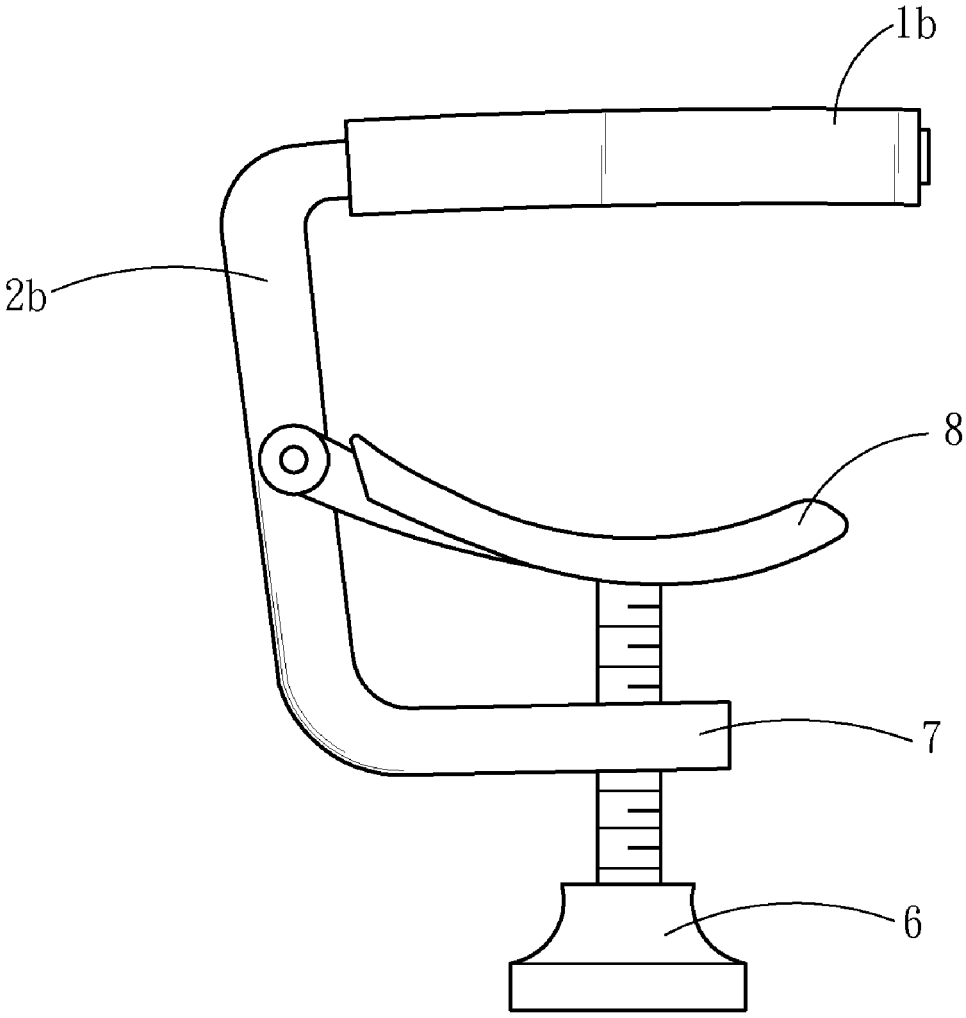
Fig. 2 PRIOR ART
FIG. 2 is a schematic view of a second conventional capo.
Figure 3:
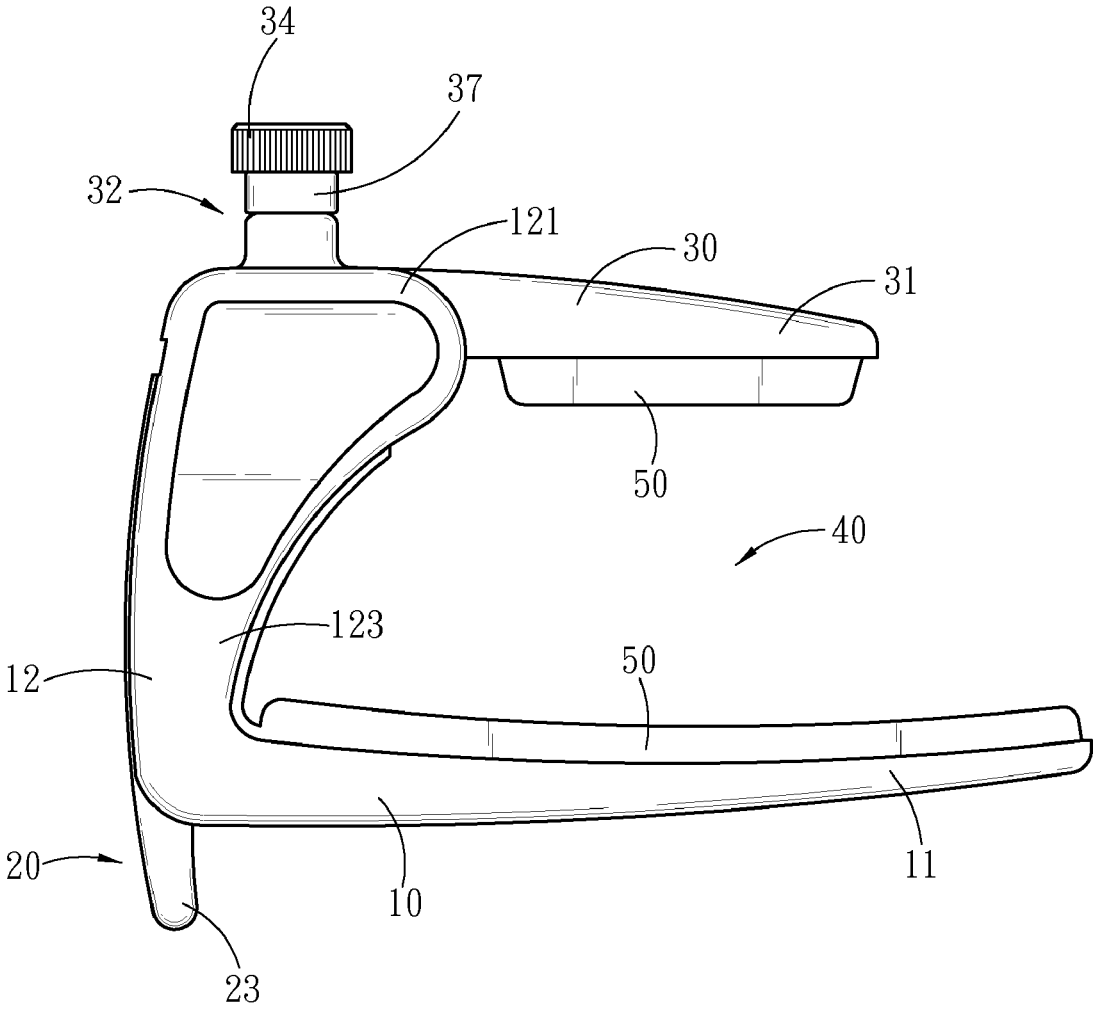
FIG. 3 is a side view of the invention.
Figure 4:
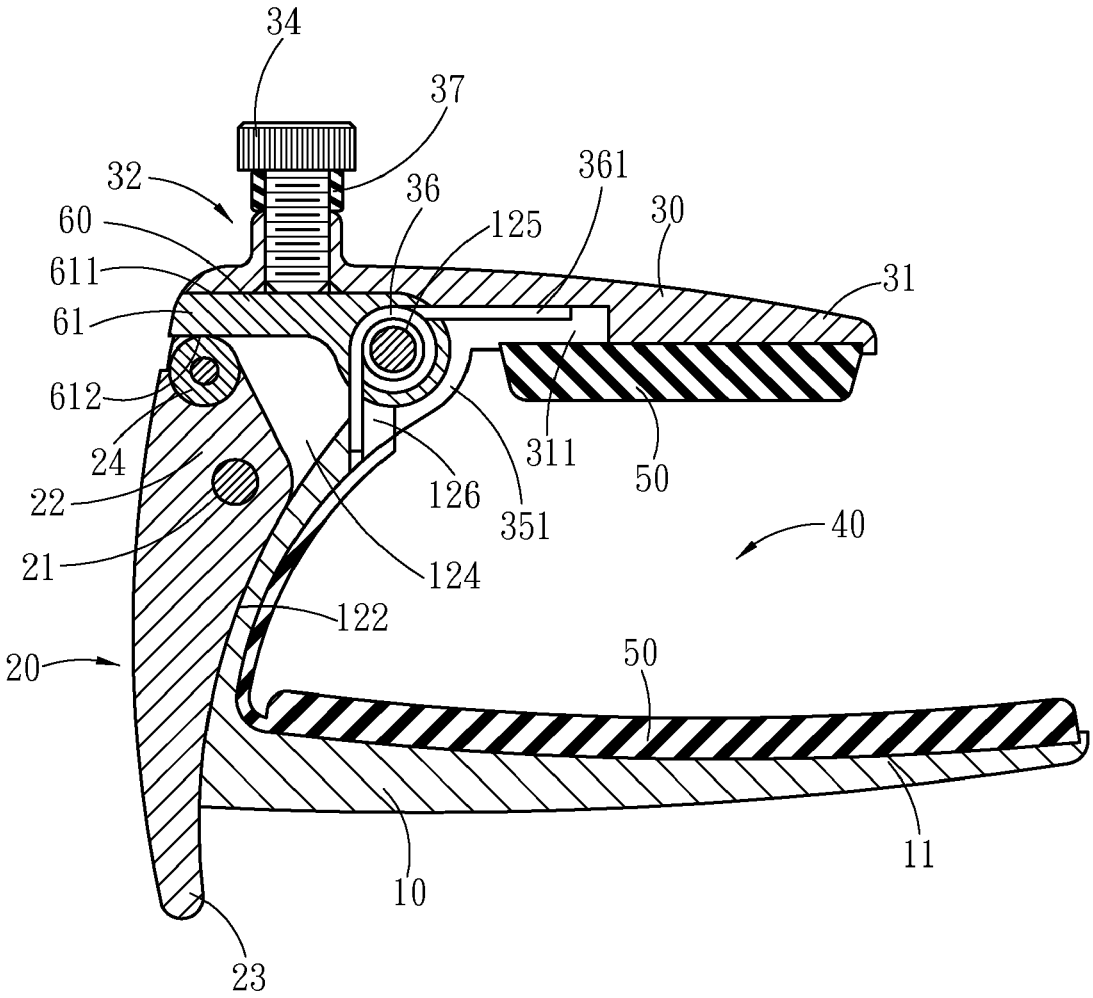
FIG. 4 is sectional side view of the invention.
Figure 5:
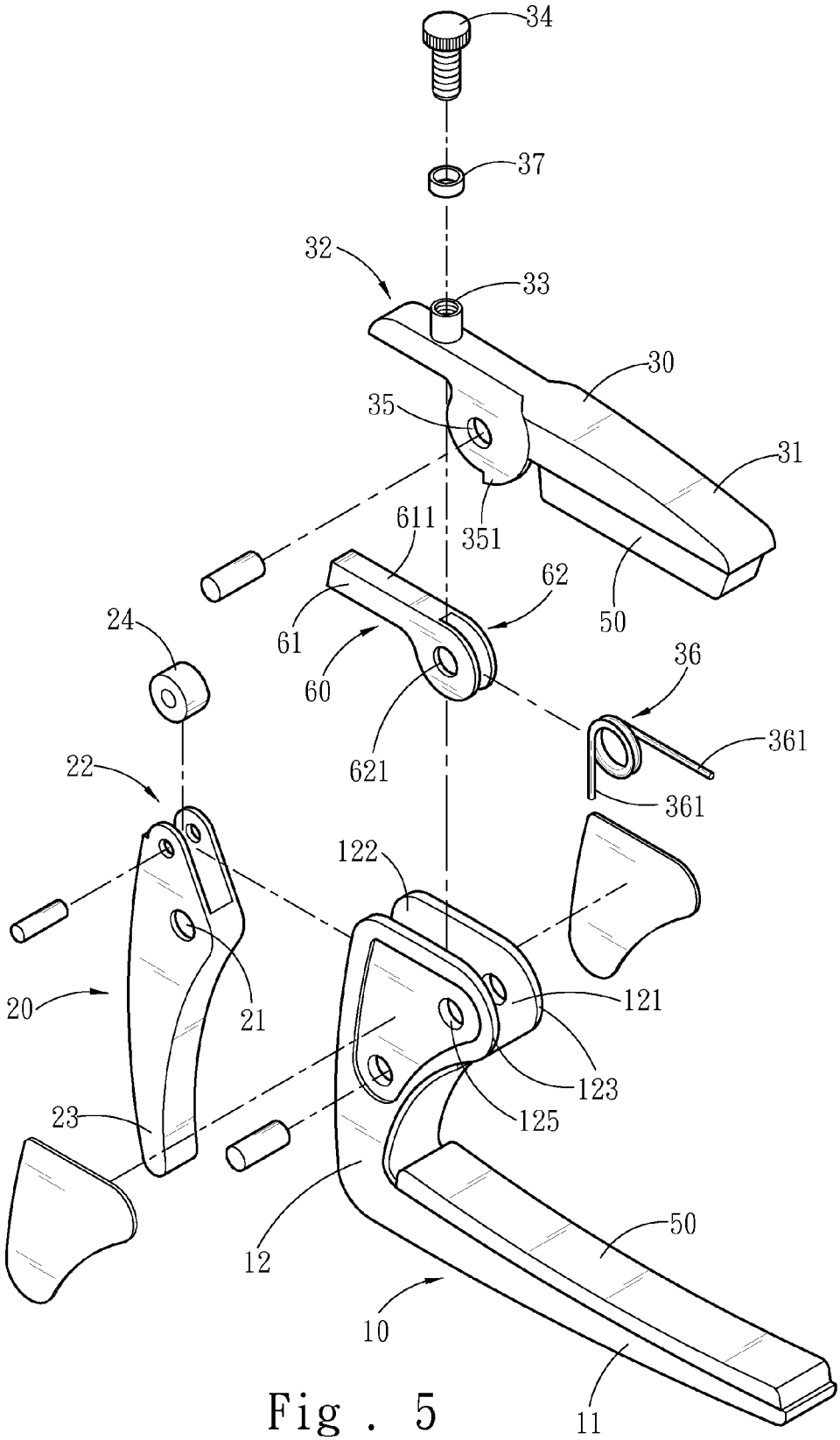
FIG. 5 is an exploded view of the invention.

Please refer to FIGS. 3, 4 and 5, the present invention provides a capo. It includes a string press element 10, a trigger 20 and a lever clamp 30. The string press element 10 has two ends, one is a string press end 11 and the other end extended upwards to form an arm 12 with an action end 121. The arm 12 has a trigger slot 122 at one side remote from the string press end 11 with two side walls 123. The action end 121 has a first axle hole 125 formed on the two side walls 123.

The trigger 20 is held in the trigger slot 122. The trigger slot 122 has a housing space 124 through the two side walls 123. The trigger 20 is held in the housing space 124. The trigger 20 is hinged in the trigger slot 122 through a second axle hole 21. The trigger 20 is an elongate plank with an upper end and a lower end. The upper end is a sliding end 22. The lower end is an operating end 23. The sliding end 22 has a roller 24 hinged thereon to facilitate sliding. The operating end 23 is jutting below the string press end 11 to facilitate triggering.

The lever clamp 30 has a clamping end 31 and an adjustment end 32. The adjustment end 32 is located above the sliding end 22 of the trigger 20, and has a screw hole 33 run through by an adjustment screw 34. The adjustment end 32 further is coupled with a pressing washer 37 run through by the adjustment screw 34 to form a firm fastening with the screw hole 33. The lever clamp 30 has a first trenched axle 35 at a lower side. The first trenched axle 35 and an elastic element 36 are hinged on the first axle hole 125. The clamping end 31 and the string press end 11 jointly form a clamping opening 40. The string press end 11 and the clamping end 31 have respectively a rubber pad 50 located thereon facing each other.

The elastic element 36 is a returning spring with two holding ends 361. The arm 12 has a first holding spot 126 at one side close to the string press end 11 and below the first axle hole 125. The lever clamp 30 has a second holding spot 311 located below the clamping end 31. The first and second holding spots 126 and 311 aim to hold the two holding ends 361 of the elastic element 36. When the clamping end 31 is moved downwards to do clamping, the second holding spot 311 also stops two detent edges 351 formed on the first trenched axle 35.

The invention further has a butting element 60 with a butting end 61 at one end and a hinge end 62 at the other end. The hinge end 62 is clamped and coupled with the first trenched axle 35 from both sides. The butting end 61 is interposed between the sliding end 22 and the adjustment end 32. The hinge end 62 further has a second trenched axle 621 narrower than the first trenched axle 35 to be clipped therein. The second trenched axle 621 also is pivotally coupled with the elastic element 36. The butting end 61 has a leaning surface 611 and a butting surface 612. The butting surface 612 allows the sliding end 22 to slide thereon. The leaning surface 611 allows the adjustment screw 34 to rest thereon for adjustment.

Figure 6:
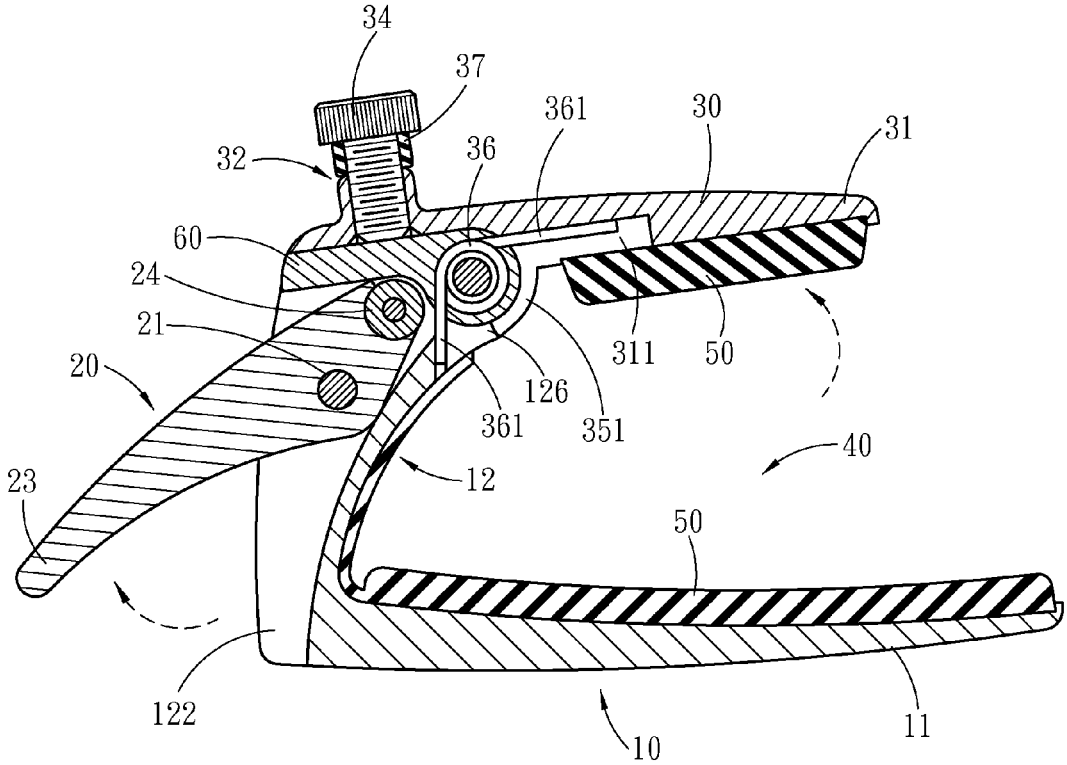
FIG. 6 is a sectional side view of the invention in a use condition.
Figure 7:
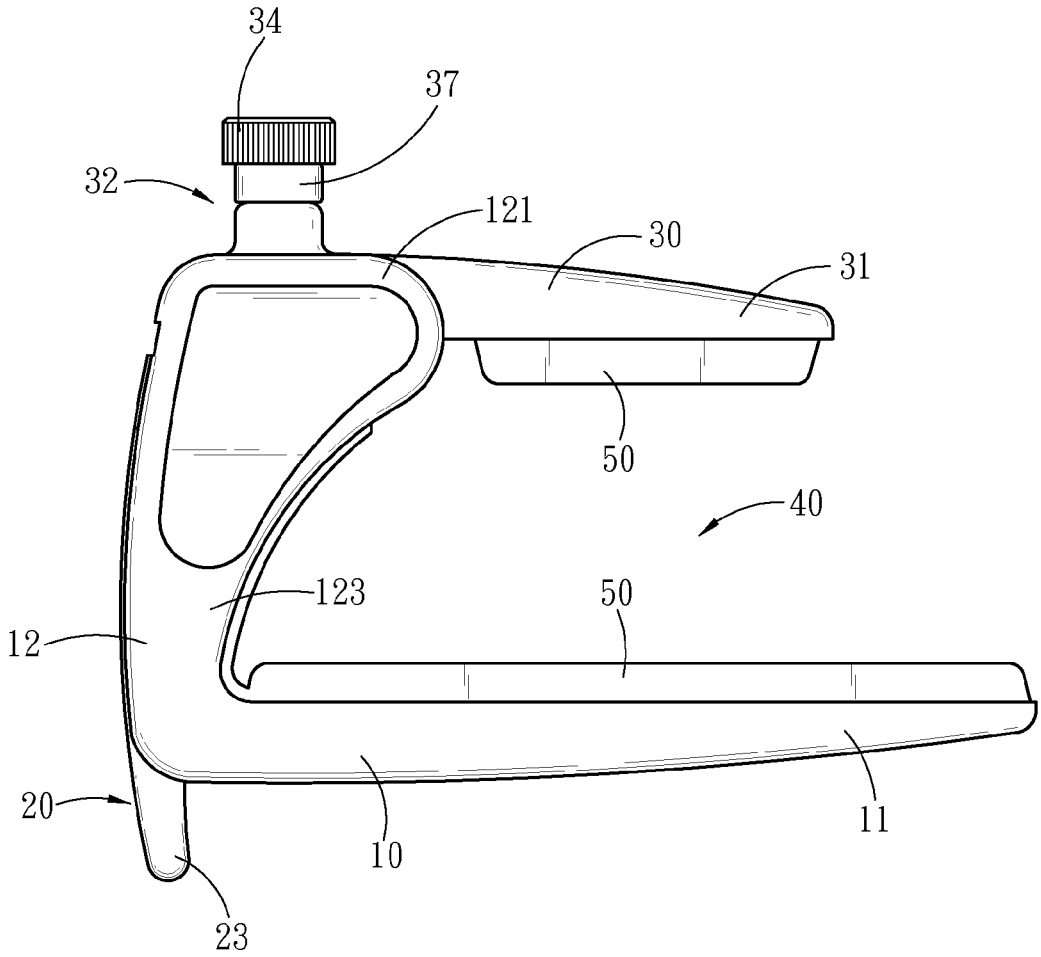
FIG. 7 is a schematic view of another embodiment of the invention.

Refer to FIG. 6 for the invention in use and FIG. 7 for another embodiment. When in use, the operating end 23 of the trigger 20 is moved away from the arm 12, the roller 24 of the sliding end 22 slides on the butting surface 612 and enters the housing space 124 of the trigger slot 122. Through the first trenched axle 35 and the elastic element 36, the adjustment end 32 and the butting element 60 are moved downwards, and the clamping end 31 is moved upwards. As a result, the clamping opening 40 becomes larger so that the string press element 10 and the clamping end 31 can clamp the frets of a guitar. By adjusting the distance of adjustment screw 34 on the leaning surface 611, it can be used on the frets of different guitars. The string press end 11 can be either a flat or a curved surface. FIG. 3 shows the string press end 11 formed with a flat surface for use on frets of classic music guitars, while FIG. 7 shows the string press end 11 formed with a curved surface for use on frets of folk music guitars.

As a conclusion, the invention provides the first axle hole 125, sliding end 22 and second axle hole 21 that form triangular fulcrums. Incorporating with the lever clamp 30 and roller 24, the clamping opening 40 can be adjusted easier and simpler to do clamping. Compared with the conventional techniques, it offers a lot of improvements, such as: first, with movements of the string press element 10 and the lever clamp 30, and the trigger 20, the clamping opening 40 is formed to provide clamping as desired. Users can easily and quickly move the operating end 23 single-handed with less effort. It greatly helps performers to provide smooth performance. Moreover, the roller 24 at the sliding end 22 can slide easily on the butting surface 612 and reduce wearing of the butting surface 612. Second, through the butting element 60 and adjustment screw 34, the clamping opening 40 can be easily adjusted through the lever clamp 30. Third, when the clamping opening 40 clamps a fret of a guitar, the two detent edges 351 of the first trenched axle 35 are stopped by the first holding spot 126 to prevent too much compression on the elastic element 36 that might cause elastic fatigue or damage of the lever clamp 30. Fourth, the pressing washer 37 allows the adjustment screw 34 to be fastened firmer that prevents loosening of the adjustment screw 34 caused by sound wave vibration during playing of the guitar. Noise generation also can be reduced.

In addition to improvement of practicality, the invention also provides a greater aesthetic appeal. The trigger 20 can be easily held in the trigger slot 122. The first trenched axle 35 allows the lever clamp 30 to be hinged easily. The whole profile is neat and simpler, and provides an elegant match with performers to enhance appeal.

What is claimed is:

1. A capo, comprising:

a string press element;

a trigger; and a clamping lever;

wherein the string press element includes a length with two ends, a first end being a string pressing end and a second end joining to a perpendicularly extending arm, the arm including an action end, providing two sidewalls enclosing a trigger slot, and including first and second axle holes on the sidewalls, the first and second axle holes being provided with axles for holding the trigger and clamping level;

wherein the trigger is an elongate arm and includes a first and second end and a length, a sliding end at the first end, and a user operating end at the second end, the trigger further including first axle holes at an intermediate position of the length, the trigger being mounted within the trigger slot of the string press element by coupling the second axle holes of the string press element and the first axle holes of the trigger through the axle;

wherein the clamping lever includes a length, an intermediate portion, a clamping end, and an adjustment end, the clamping end contacts an instrument neck for clamping, and the adjustment end adjustably interfaces the sliding end of the trigger, the adjustment end further including a screw hole, an adjustment screw, an abutting adjustment arm, and an elastic element, the abutting adjustment arm including a sliding contact to engage the sliding end of the trigger, an opposite surface to contact the adjustment screw, and axle holes to pivot with respect to the clamping lever, and the elastic element biasing the clamping lever open;

wherein the intermediate portion includes two sidewalls to form a first trench receiving a butting element, and axle holes on the sidewalls, the first trench being received in the trigger slot of the string press element by coupling the first axle holes of the string press element and the axle holes of the clamping lever through the axle; and wherein the butting element has a butting end at one end and a hinge end at the other end, the hinge being coupled with the intermediate portion that pivotally interconnects the arm of the string press element with the clamping lever, the butting end being interposed between the sliding end of the trigger and the adjustment end of the clamping lever.

2. The capo of claim 1, wherein the trigger slot has a housing space formed between the two side walls to hold the trigger, the operating end jutting below the string press end to facilitate triggering.

3. The capo of claim 1, wherein the string press end and the clamping end have respectively a rubber pad located thereon facing each other, the string press end being selectively formed with a flat surface or a curved surface.

4. The capo of claim 1, wherein the elastic element is a returning spring and has two holding ends.

5. The capo of claim 4, wherein the arm has a first holding spot at one side close to the string press end below the first axle hole, the lever clamp having a second holding spot located below the clamping end, the first holding spot and the second holding spot holding the two holding ends of the elastic element, the second holding spot stopping two detent edges of the first trenched axle when the clamping end is moved downwards to perform clamping.

6. The capo of claim 1, wherein the hinge end includes two sidewalls to form a second trench receiving the elastic element, and axle holes on the sidewalls.

7. The capo of claim 1, wherein the butting end has a seating surface and an abutting surface, the abutting surface being slidable by the sliding end, the leaning surface being pressed by the adjustment screw for adjustment.

8. The capo of claim 1, wherein the sliding end is hinged with a roller to facilitate sliding.

9. The capo of claim 1, wherein the adjustment end is coupled with a pressing washer run through by the adjustment screw to form a firm fastening between the adjustment screw and the screw hole.

* * * * *